US012595755B2

(12) United States Patent
Andrisani

(10) Patent No.: US 12,595,755 B2
(45) Date of Patent: Apr. 7, 2026

(54) ROCKER ARM FOR BRAKE WITH INTEGRATED HYDRAULIC CAPSULE

(71) Applicant: Eaton Intelligent Power Limited, Dublin (IE)

(72) Inventor: Nicola Andrisani, Cumiana (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/972,251

(22) Filed: Dec. 6, 2024

(65) Prior Publication Data

US 2025/0101891 A1 Mar. 27, 2025

Related U.S. Application Data

(63) Continuation of application No. PCT/EP2023/025290, filed on Jun. 22, 2023.
(Continued)

(51) Int. Cl.
*F01L 13/06* (2006.01)
*F01L 1/18* (2006.01)
*F01L 1/24* (2006.01)

(52) U.S. Cl.
CPC ..... *F01L 13/065* (2013.01); *F01L 1/181* (2013.01); *F01L 1/2411* (2013.01)

(58) Field of Classification Search
CPC ..... F01L 13/065; F01L 1/181; F01L 1/2411; F01L 2305/00; F01L 1/24; F01L 1/2416; F01L 1/267; F01L 13/0031
See application file for complete search history.

(56) References Cited

U.S. PATENT DOCUMENTS 5,462,025 A * 10/1995 Israel ..... F01L 13/065 123/321
7,905,208 B2 * 3/2011 Ruggiero ..... F01L 1/26 123/90.22

(Continued)

FOREIGN PATENT DOCUMENTS

CN 102165149 A * 8/2011 ..... F01L 13/065
CN 104500164 A 4/2015

(Continued)

OTHER PUBLICATIONS

International search report and Written Opinion received for PCT Application No. PCT/EP23/25290, 11 pages, Oct. 6, 2023.

*Primary Examiner* — Hung Q Nguyen
(74) *Attorney, Agent, or Firm* — Baker Botts L.L.P.

(57) ABSTRACT

A hydraulic capsule for use in a rocker arm comprises a housing having an upper chamber that receives fluid and a lower chamber in fluid communication with the upper chamber, a pin disposed in the upper chamber and configured to be hydraulicly controlled to extend and/or retract, a check valve assembly disposed in the lower chamber and configured to selectively enable fluid communication between the upper chamber and the lower chamber based on the position of the pin, a plunger disposed in the lower chamber and configured to be hydraulicly controlled to move between an extended position and a retracted position, and a first spring coupled to the plunger and configured to bias the plunger in the retracted position. Particularly, in the retracted position, the plunger does not engage a valve bridge. In the extended position, the plunger is able to engage the valve bridge.

20 Claims, 7 Drawing Sheets

Related U.S. Application Data

(60) Provisional application No. 63/366,987, filed on Jun. 24, 2022.

(56) References Cited

U.S. PATENT DOCUMENTS

| | | | | |
|---|---|---|---|---|
| 8,851,048 | B2 | 10/2014 | Meistrick | |
| 10,794,242 | B2 * | 10/2020 | Persson | F01L 1/181 |
| 2008/0223325 | A1 * | 9/2008 | Meistrick | F01L 13/065 123/90.46 |
| 2012/0298057 | A1 * | 11/2012 | Janak | F01L 1/08 123/90.12 |
| 2015/0144096 | A1 * | 5/2015 | Meneely | F01L 1/181 123/321 |
| 2017/0276035 | A1 * | 9/2017 | Cecur | F01L 1/2416 |
| 2018/0087412 | A1 * | 3/2018 | Andrisani | F02D 13/04 |
| 2019/0055861 | A1 * | 2/2019 | Persson | F01L 13/065 |
| 2021/0131318 | A1 * | 5/2021 | Vanwingerden | F01L 1/047 |

FOREIGN PATENT DOCUMENTS

| | | | | | |
|---|---|---|---|---|---|
| GB | 2536927 | A | * | 10/2016 | F02D 13/04 |
| WO | WO-2010014914 | A1 | * | 2/2010 | F01L 13/065 |
| WO | WO 2014015292 | A2 | | 1/2014 | |
| WO | WO-2015120897 | A1 | * | 8/2015 | F01L 1/2416 |
| WO | WO 2019228671 | A1 | | 12/2019 | |
| WO | WO-2020014637 | A1 | * | 1/2020 | F01L 13/065 |
| WO | WO 2023151871 | A1 | | 8/2023 | |
| WO | WO 2023169717 | A1 | | 9/2023 | |
| WO | WO 2023222254 | A1 | | 11/2023 | |

* cited by examiner

ROCKER ARM FOR BRAKE WITH INTEGRATED HYDRAULIC CAPSULE

PRIORITY

This application claims the benefit under 35 U.S.C. § 365(c) of International Patent Application No. PCT/EP2023/025290, filed 22 Jun. 2023, which claims the benefit under 35 U.S.C. § 119(e) of U.S. Provisional Patent Application No. 63/366,987, filed 24 Jun. 2022, each of which is incorporated herein by reference.

TECHNICAL FIELD

This disclosure generally relates to a rocker arm assembly in a valve train system, and more particularly to a rocker arm for brake with integrated hydraulic capsule.

BACKGROUND

Valve train assembly can be used to provide engine brake functionality to a combustion engine. In this field, this type of engine brake is also called compression engine brake. For being able to brake with the engine, compressed air at the end of a compression stroke of an engine cylinder needs to be released to exhaust, such that the engine basically functions as an air compressor and thus consumes energy, which is derived from a drive train of a vehicle causing the vehicle to brake. Typically, a switchable system is often employed by the rocker arm for such purposes, which is selectively translatable between a retracted and extended position, the retracted position disabling actuation of a valve in the cylinder by the corresponding rocker arm and the extended position enabling actuation of the valve. In general, the switchable system may include a valve controlling activation of the system and a plunger which expands to allow engagement with a valve bridge connected to the engine valve when the switchable system is actuated. However, known designs can require the rocker arm to be manufactured to separately host the control valve and/or the actuation piston, which adds complexity and cost to the rocker arm. Further, the plunger is often set to remain extended by default, thus causing undesired contact with the valve bridge even when the brake is deactivated. This generates wear in the system and shortens service life of the assembly.

Accordingly, there is a need to provide a solution that simplifies the overall structure and at the same time prevents unintended contact with the valve bridge.

SUMMARY OF PARTICULAR EMBODIMENTS

The disclosure presents a hydraulic capsule that integrates the control and activation functions into one single body, thereby streamlining the design of the capsule structure so that both the capsule itself and the rocker arm accommodating the capsule can be more easily manufactured. Furthermore, the hydraulic capsule according to this disclosure uses a spring to bias the plunger compressed, preventing the plunger from accidentally hitting the valve bridge during brake deactivation so as to reduce wear and prolong operation life of the overall system.

An embodiment of a hydraulic capsule for use in a rocker arm comprises an integrated housing comprising an upper chamber configured to receive pressurized fluid and a lower chamber configured to be in fluid communication with the upper chamber, a pin disposed in the upper chamber and configured to be hydraulicly controlled to move between an extended position and a retracted position, a check valve assembly disposed in the lower chamber and configured to selectively enable fluid communication between the upper chamber and the lower chamber based on the position of the pin, a plunger at least partially disposed in the lower chamber and configured to be hydraulicly controlled to move between an extended position and a retracted position, and a first spring coupled to the plunger and configured to bias the plunger in the retracted position. Particularly, in the retracted position of the plunger, the plunger does not engage a valve bridge during rotation of the rocker arm. In the extended position of the plunger, the plunger is able to engage the valve bridge during rotation of the rocker arm.

In particular embodiments, the first spring is coupled to a lower end of the plunger. In particular embodiments, the hydraulic capsule further comprises a spring seat attached to a lower end of the lower chamber and configured to support the first spring. In particular embodiments, the plunger is configured to move to the extended position under hydraulic pressure inside the lower chamber.

In particular embodiments, the hydraulic capsule further comprises a second spring coupled to the pin and configured to bias the pin in the extended position. In particular embodiments, the pin is configured to move to the retracted position under hydraulic pressure inside the upper chamber. In particular embodiments, when the pin is in the extended position, the pin opens the check valve assembly to enable fluid communication between the upper chamber and the lower chamber.

In particular embodiments, the hydraulic capsule further comprises an opening between the upper chamber and the lower chamber for fluid communication. In particular embodiments, the check valve assembly is disposed below the opening.

In particular embodiments, the plunger is in the extended position when the rocker arm is in engine brake mode and is in the retracted position when the rocker arm is in drive mode.

An embodiment of a rocker arm assembly for engine braking comprises a rocker arm having a valve end and a hydraulic capsule disposed in the valve end. The hydraulic capsule comprises an integrated housing comprising an upper chamber configured to receive pressurized fluid and a lower chamber configured to be in fluid communication with the upper chamber, a pin disposed in the upper chamber and configured to be hydraulicly controlled to move between an extended position and a retracted position, a check valve assembly disposed in the lower chamber and configured to selectively enable fluid communication between the upper chamber and the lower chamber based on the position of the pin, a plunger at least partially disposed in the lower chamber and configured to be hydraulicly controlled to move between an extended position and a retracted position, and a first spring coupled to the plunger and configured to bias the plunger in the retracted position. Particularly, in the retracted position of the plunger, the plunger does not engage a valve bridge during rotation of the rocker arm. In the extended position of the plunger, at least a portion of the plunger extends outwards from the valve end and is able to engage the valve bridge during rotation of the rocker arm.

In particular embodiments, the rocker arm assembly further comprises a fluid circuit routed inside the rocker arm for supplying pressurized fluid to the hydraulic capsule. In particular embodiments, the rocker arm further comprises a cam end for receiving motion from a camshaft. In particular embodiments, the rocker arm assembly further comprises a lost motion spring coupled to the cam end and configured to bias the rocker arm against the camshaft.

In particular embodiments, the integrated housing of the hydraulic capsule is generally cylindrical in shape. In particular embodiments, the valve end is structured with a bore for receiving the hydraulic capsule.

In particular embodiments, the first spring is coupled to a lower end of the plunger. In particular embodiments, the hydraulic capsule further comprises a spring seat attached to a lower end of the lower chamber and configured to support the first spring. In particular embodiments, the plunger is configured to move to the extended position under hydraulic pressure inside the lower chamber. In particular embodiments, the plunger is in the extended position when the rocker arm is in engine brake mode and is in the retracted position when the rocker arm is in drive mode.

BRIEF DESCRIPTION OF THE DRAWINGS

Embodiments in accordance with this disclosure will now be described by reference to the accompanying drawings, in which.

DESCRIPTION OF EXAMPLE EMBODIMENTS

Reference will now be made in detail to the examples which are illustrated in the accompanying drawings. Wherever possible, the same reference numbers will be used throughout the drawings to refer to the same or like parts. Directional references such as "up", "down", "right", and "left" are for ease of reference to the figures and not intended to limit the scope of this disclosure.

Figure 1:
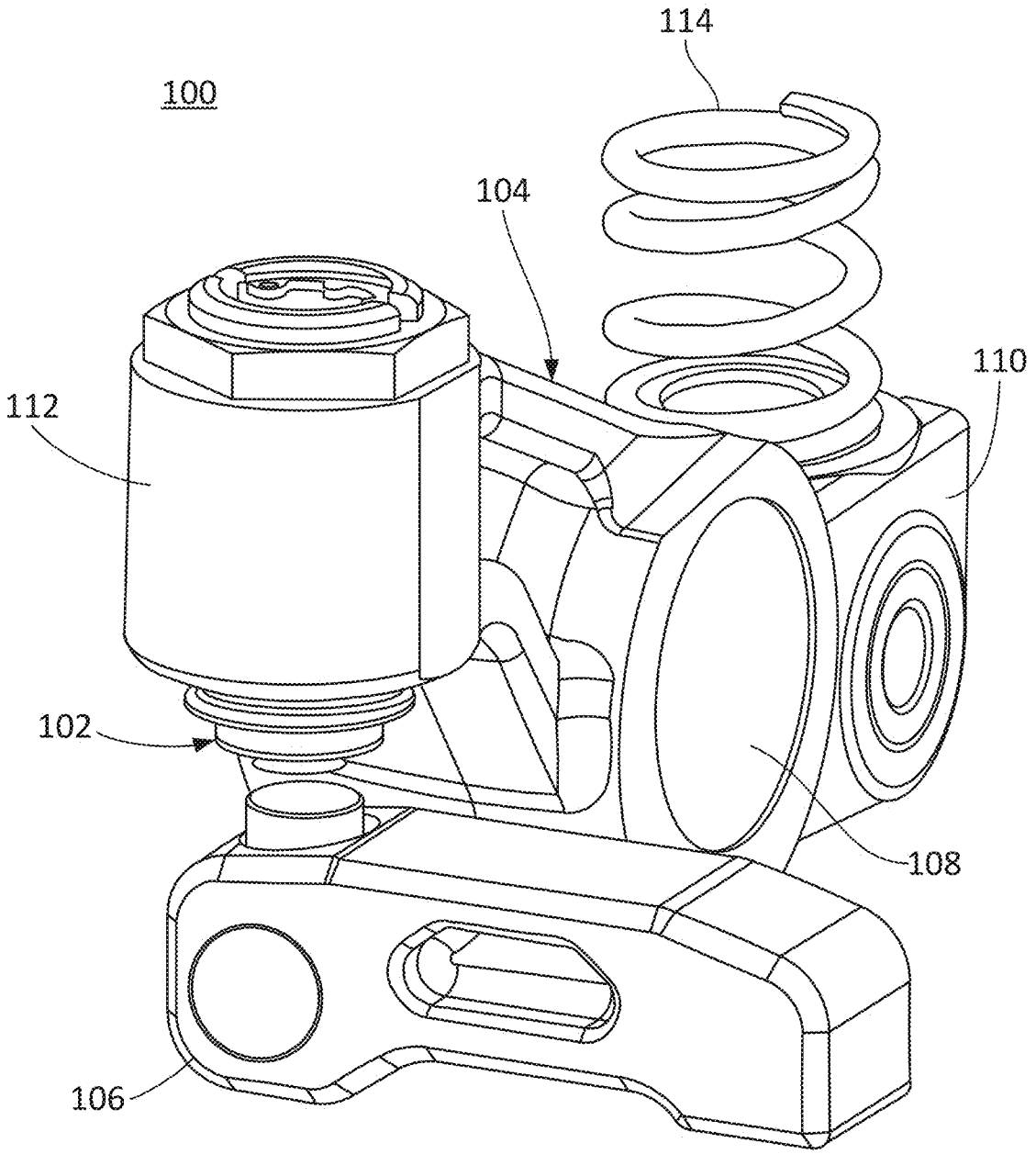
FIG. 1 illustrates a rocker arm assembly that incorporates an integrated hydraulic capsule according to this disclosure.

FIG. 1 illustrates an example rocker arm assembly 100 incorporating an integrated hydraulic capsule 102 in accordance with one embodiment of this disclosure. In particular embodiments, the rocker arm assembly 100 may include a dedicated rocker arm 104 for compression engine braking that selectively acts on one of two engine valves (not shown) coupled to a valve bridge 106. In practice, although not illustrated, another exhaust rocker arm may be provided in parallel to the rocker arm 104 and serves to simultaneously enable actuation of both engine valves through the valve bridge 106. While described in this particular manner, it will be appreciated however that the present disclosure is not so limited. A person of skill in the art will understand that various embodiments disclosed herein may similarly be applicable in other suitable rocker arm configurations, such as a dual exhaust valve rocker arm that operatively combines exhaust and engine brake capabilities in the same rocker arm body.

In the embodiment shown in FIG. 1, the rocker arm 104 may be pivotably supported by a rocker shaft (not shown) extending through a central opening 108 such that the rocker arm 104 may rotate around the rocker shaft based on a cam lift profile of an engine brake lift cam. Specifically, a cam end 110 of the rocker arm 104 may be operatively coupled to the engine brake lift cam for receiving valve actuation motion. A valve end 112 opposite to the cam end 110 may in turn be configured to selectively engage the valve bridge 106 on demand so as to transfer motion from the cam to one of the engine valves coupled to the valve bridge 106. In some embodiments, an optional lost motion spring 114 may be coupled to the cam end 110 for biasing the rocker arm 104 downwards against the cam, for example, to accommodate mechanical lash. Alternatively, the rocker arm assembly 100 may function without the lost motion spring 114 or instead may be provided with other suitable lost motion components as familiar to those skilled in the art without departing from the scope of this disclosure.

It may be desirable to configure the rocker arm assembly 100 to be selectively switchable such that one can choose whether the engine brake lift cam can actuate the associated valve or not. That is, the rocker arm assembly 100 may transfer between a drive mode (i.e., the valve end 112 is spaced from contact relative to the valve bridge 106, thus the associated valve remains unactuated regardless of rocker arm rotation) and an engine brake mode (i.e., the valve end 112 engages the valve bridge 106 as the rocker arm 104 reciprocates, allowing motion to be delivered to the valve.) To this end, the hydraulic capsule 102 may be provided in the valve end 112 of the rocker arm 104. The hydraulic capsule 102 may be controlled hydraulicly by pressurized fluid supplied via a fluid circuit running through the rocker arm 104 and configured to move between a retracted position and an extended position. In particular embodiments, for example, the hydraulic capsule 102 may be received by a vertical bore arranged in the valve end 112 of the rocker arm 104. During operation, the hydraulic capsule 102 may be actuated on demand to either protrude outwards from the bottom of the valve end 112 to contact the valve bridge 106 or retract back into the valve end 112 to avoid touching the valve bridge 106. This will be explained in great details below.

Figure 2:
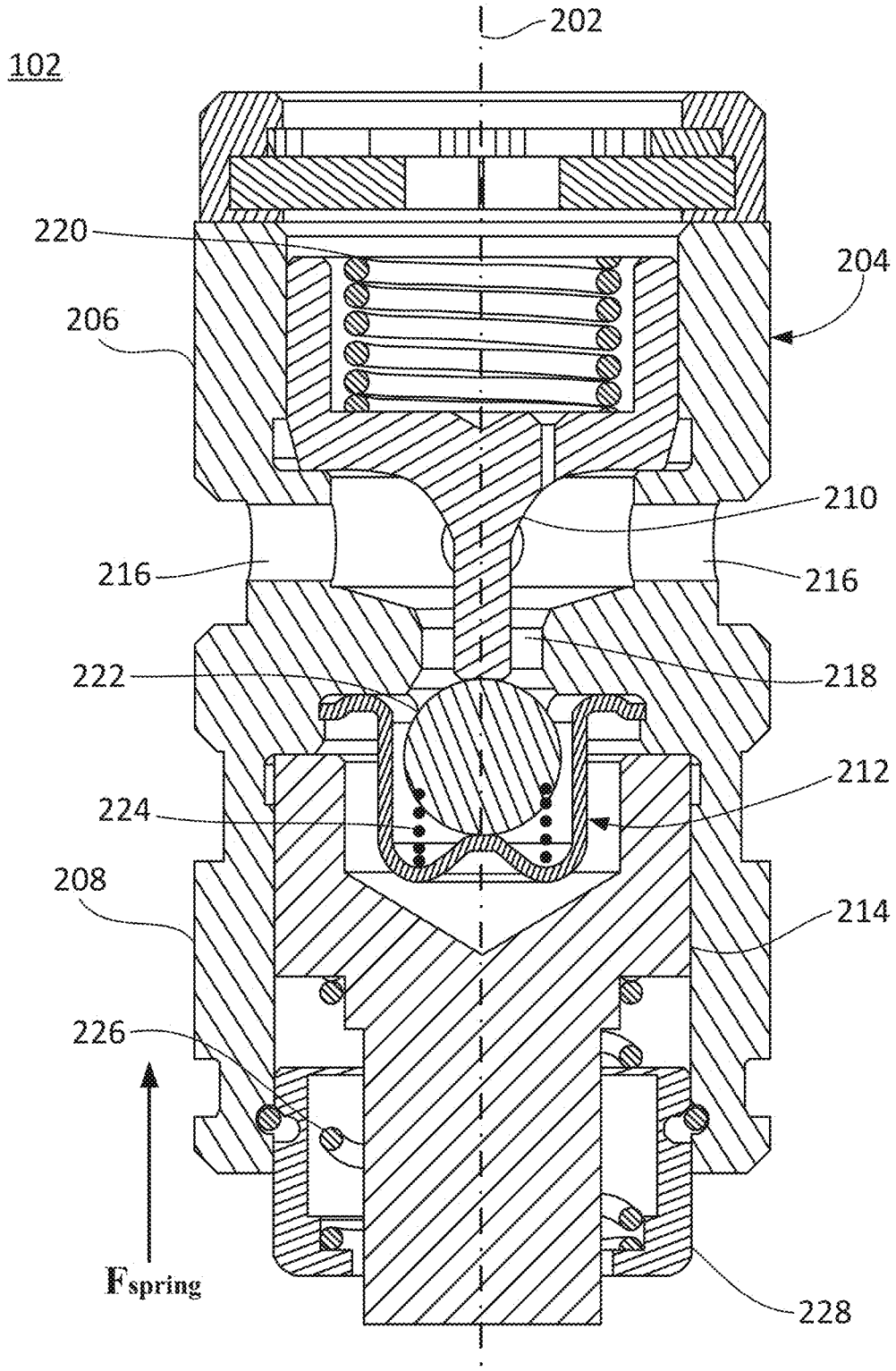
FIG. 2 illustrates a cross-sectional view of the integrated hydraulic capsule, specifically delineating its various components.

FIG. 2 illustrates a cross-sectional view of the integrated hydraulic capsule 102 taken along a capsule axis 202, particularly showing the hydraulic capsule 102 in its retracted state. In particular embodiments, the hydraulic capsule 102 may comprise a housing 204, which is generally cylindrical in shape and may include an upper chamber 206 and a lower chamber 208. In the example as shown, the upper chamber 206 and the lower chamber 208 may together form a single body that defines the housing 204 for housing and/or containing various components of the hydraulic capsule 102 in an in-line manner. For example, the upper chamber 206 may house a pin 210 while the lower chamber 208 may house a check valve assembly 212 and a plunger 214, each being aligned along the capsule axis 202. By containing the components in an integrated housing body, the embodiments disclosed herein may achieve a compact yet simplified capsule structure, thereby reducing complexity and cost of the overall system. Moreover, cylindrical symmetry of the hydraulic capsule according to this disclosure may provide added benefits of easy manufacturing of the assembly.

As shown in FIG. 2, the upper chamber 206 may be ported with one or more fluid channels 216, which, for example, may be arranged circumferentially on a side wall of the upper chamber 206 and configured to receive hydraulic fluid (e.g., oil) supplied via the rocker arm 104. The lower chamber 208 may be positioned below the upper chamber 206 and is configured to be in fluid communication with the upper chamber 206 via an opening 218 disposed between the upper chamber 206 and the lower chamber 208. In this way, pressurized fluid introduced through the fluid channel 216 into the upper chamber 206 may be allowed to enter via the opening 218 to the lower chamber 208—for example, in a selective way under the control of the check valve assembly 212, details of which will be more clearly explained below.

As further illustrated in FIG. 2, the upper chamber 206 may contain the pin 210. The pin 210 may be hydraulicly controlled by fluid pressure introduced in the upper chamber 206 to compress and/or extend vertically along the capsule axis 202. As an example, in the configuration as depicted, a spring 220 may be coupled to a top end of the pin 210 and configured to bias down the pin 210 to its extended position. As fluid flows in and hydraulic pressure builds up inside the upper chamber 206, the hydraulic force may overcome the downward biasing force applied by the spring 220, consequently pushing the pin 210 in an upward direction into retraction. In particular embodiments, the check valve assembly 212 located downstream of the pin 210 may be configured to selectively enable fluid communication between the upper chamber 206 and the lower chamber 208 based on the movement of the pin 210. The check valve assembly 212 may be arranged in the lower chamber 208 in a position that is directly below the opening 218. In the embodiment as shown, the check valve assembly 212 comprises a check ball 222, which may be pressed down by the pin 210 in order to open fluid passage through the opening 218. During operation, the check ball 222 may normally seat against the opening 218, e.g., by means of a valve spring 224 urging the check ball 222 upwards. In this manner, when biased, the check ball 222 may become a one-way valve that allows fluid to flow downwards to the lower chamber 208 but prevents it to flow back in the opposite direction to the upper chamber 206. When the pin 210 moves to its extended position, a lower terminal end of the pin 210 may protrude into the opening 218 and push against the check ball 222, thereby unseating the check ball 222 from the opening 218 and allowing fluid to flow past the check ball 222 into the lower chamber 208, or vice versa.

With continued reference to FIG. 2, the lower chamber 208 may further house the plunger 214. For example, the plunger 214 may be disposed below and in line with the check valve assembly 212. In particular embodiments, the plunger 214 is configured to translate a certain distance inside the lower chamber 208 (for example, vertically along the capsule axis 202) between an extended position and a retracted position upon actuation by the fluid introduced into the lower chamber 208. For example, when the lower chamber 208 is filled with the pressurized fluid, the plunger 214 may be hydraulicly actuated in a downward direction to such a position where a lower end of the plunger 214 extends out from the bottom of the hydraulic capsule 102. In doing so, as the rocker arm 104 rotates, the plunger 214 may make contact with the valve bridge 106, thus enabling motion transmission to the downstream engine valve. In particular embodiments, a spring 226 may be coupled to the plunger 214, e.g., near a lower end of the plunger 214. For example, a spring seat 228 may be provided to support the spring 226 upwards, which is attached or fixed to an end portion of the lower chamber 208. As indicated by an arrow in FIG. 2, the spring 226 may provide an upward spring force to the plunger 214 such that when fluid pressure is removed, the plunger 214 may return into retraction. In this retracted configuration, substantial or entire portion of the plunger 214 may generally be contained within the lower chamber 208 in a manner to refrain from contacting the valve bridge 106 even when the rocker arm 104 rotates, thus deactivating the engine valve as needed. In other words, by configuring the hydraulic capsule 102 in this manner, a variable volume may be formed, which expands when pressurized fluid reaches the lower chamber 208 through the check valve assembly 212 and pushes the plunger 214 downwards, and shrinks when the check valve assembly 212 opens, releasing fluid from the lower chamber 208, in order to switch the hydraulic capsule 102 between the extended mode and the retracted mode.

The design of the hydraulic capsule 102 disclosed herein contrasts those of prior art since the plunger 214 can remain compressed as default by means of the spring 226 during engine brake deactivation, thus avoiding any contact between the hydraulic capsule 102 and the valve bridge 106. This can save the system from undesired wearing, reduce the risk of damage to the movable components, and help maintaining proper system dynamics.

Figure 3:
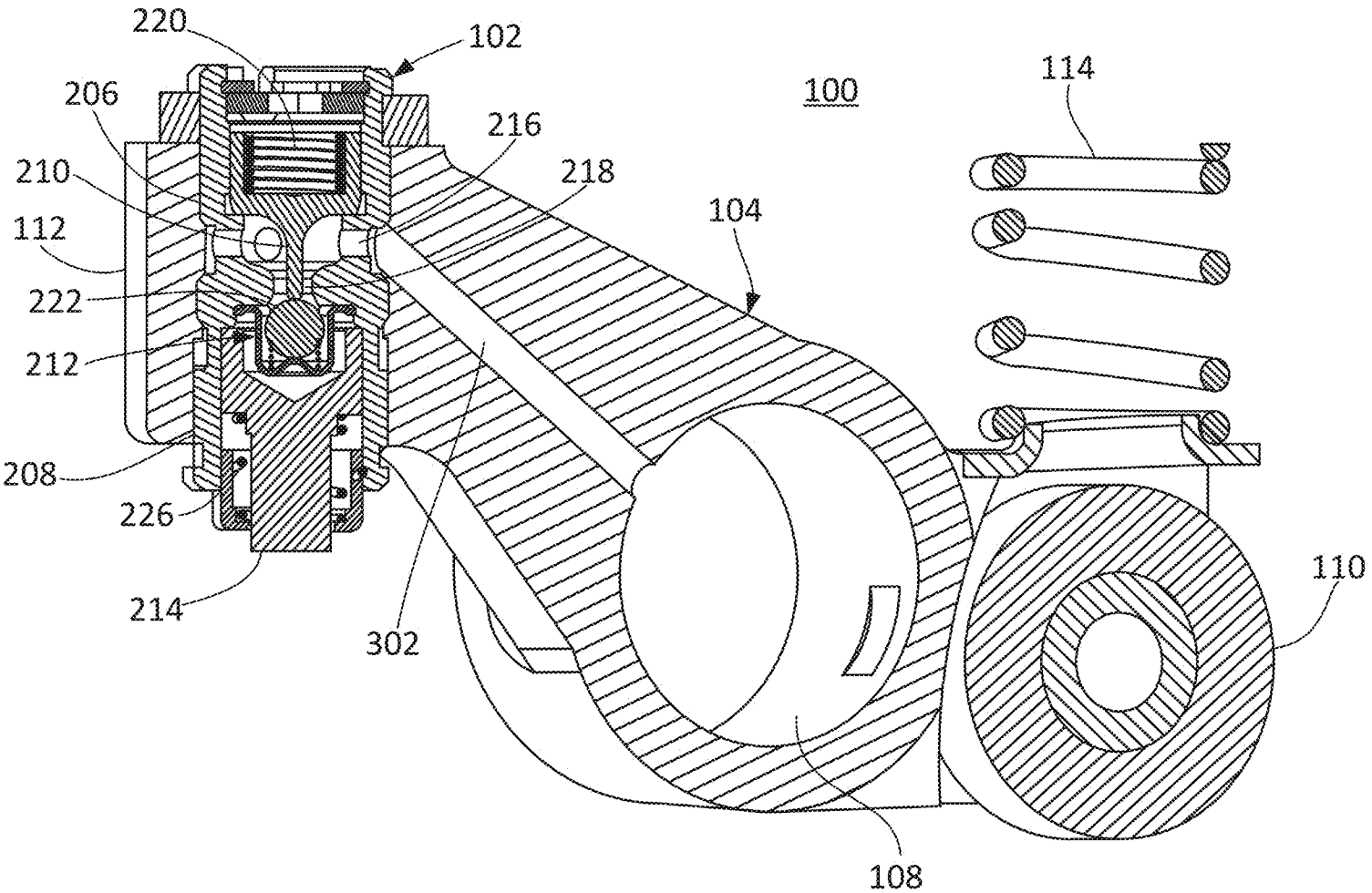
FIGS. 3-4 illustrate respective cross sections of the rocker arm assembly taken from different perspectives, showing the rocker arm assembly in drive mode.
Figure 4:
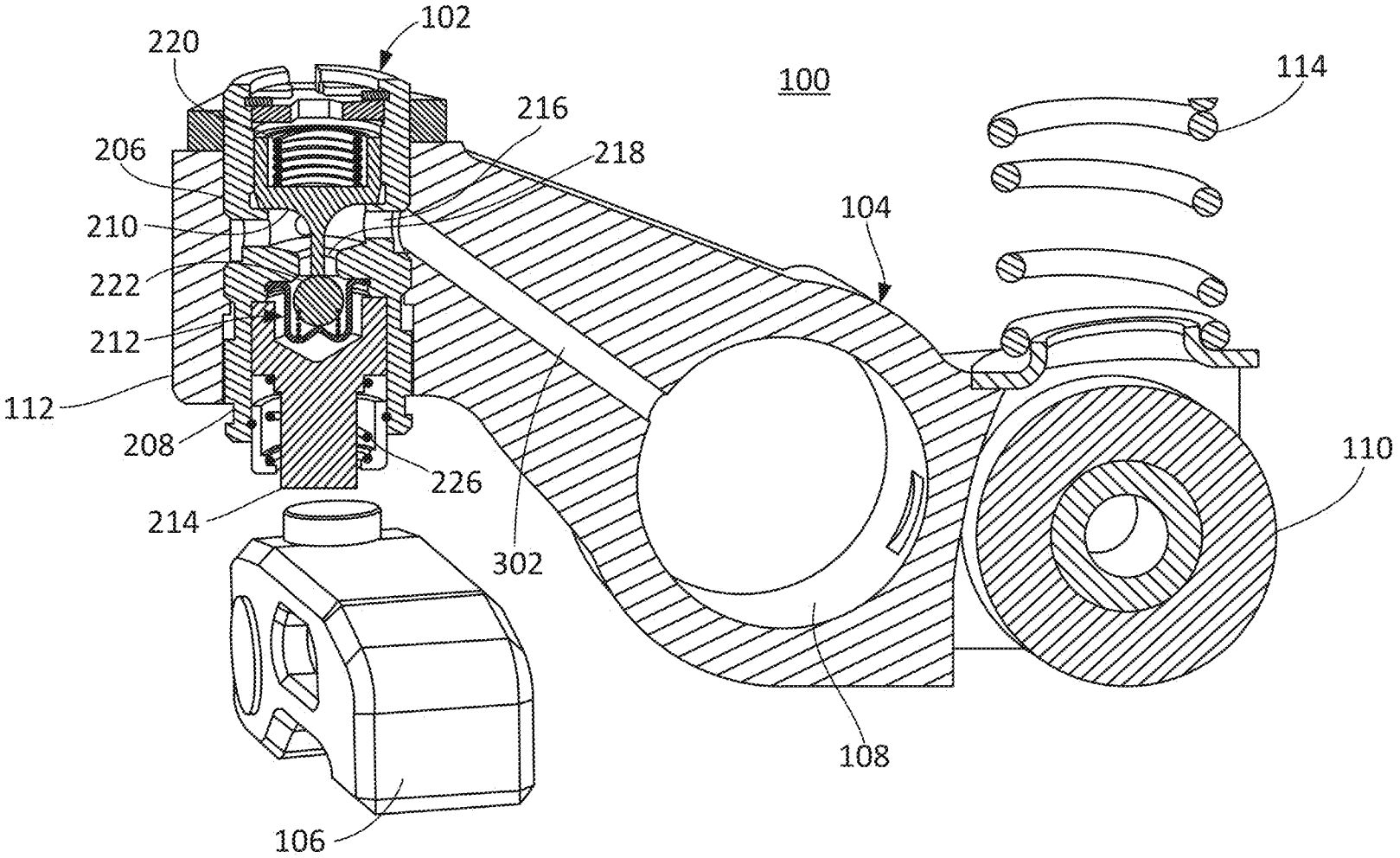
Figure 5:
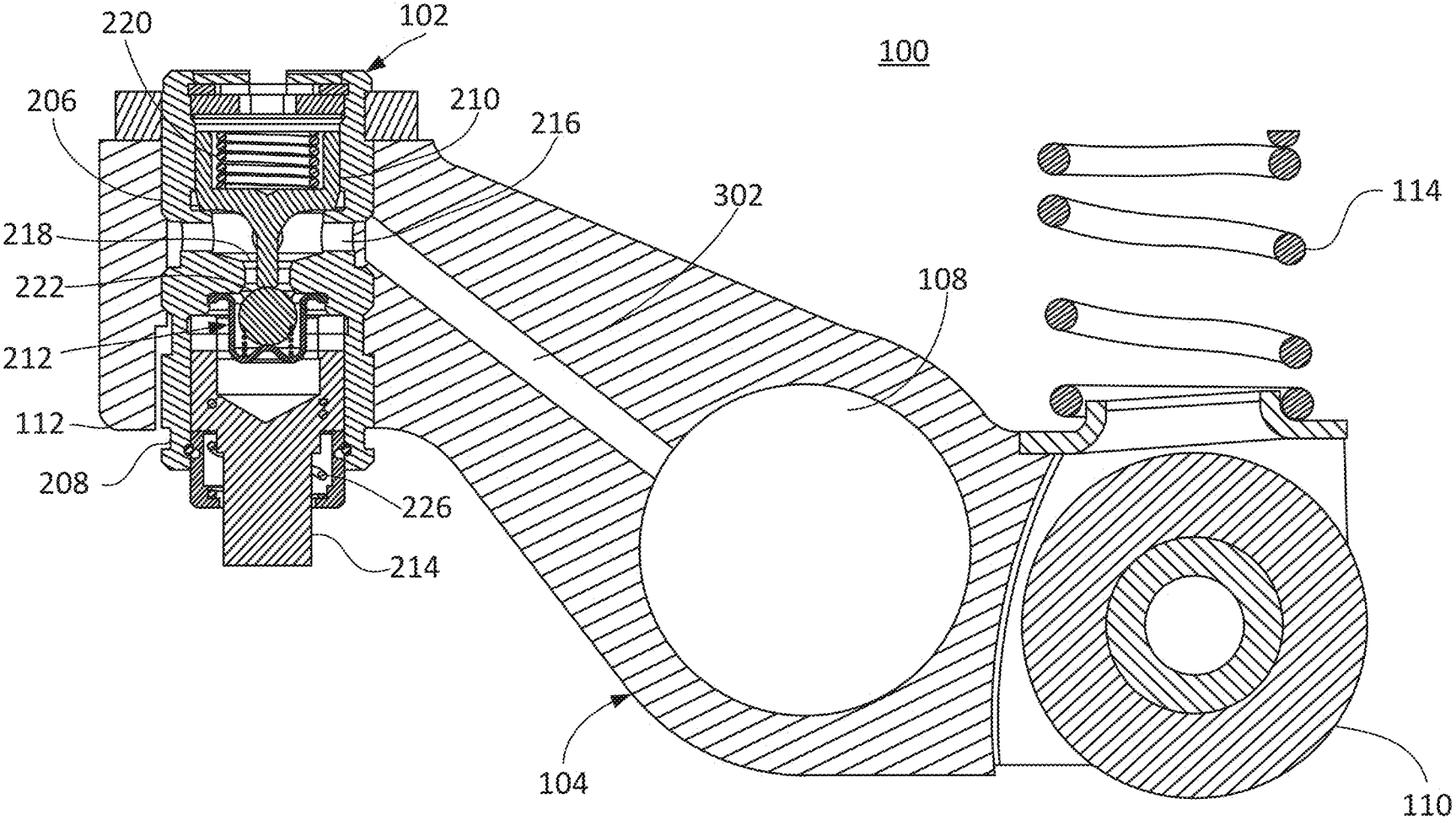
FIGS. 5-7 illustrate respective cross sections of the rocker arm assembly taken from different perspectives, showing the rocker arm assembly in engine brake mode.
Figure 6:
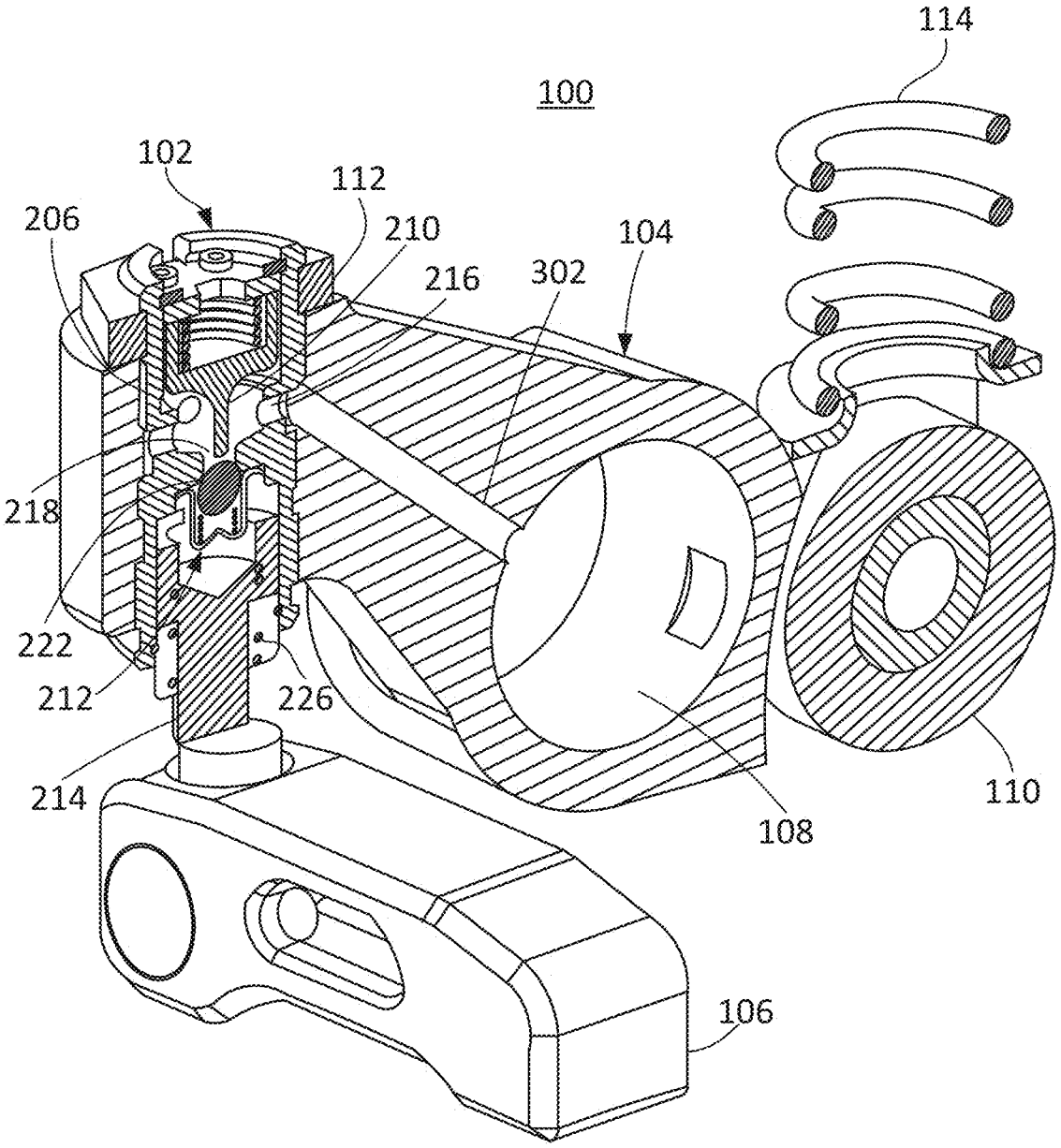
Figure 7:
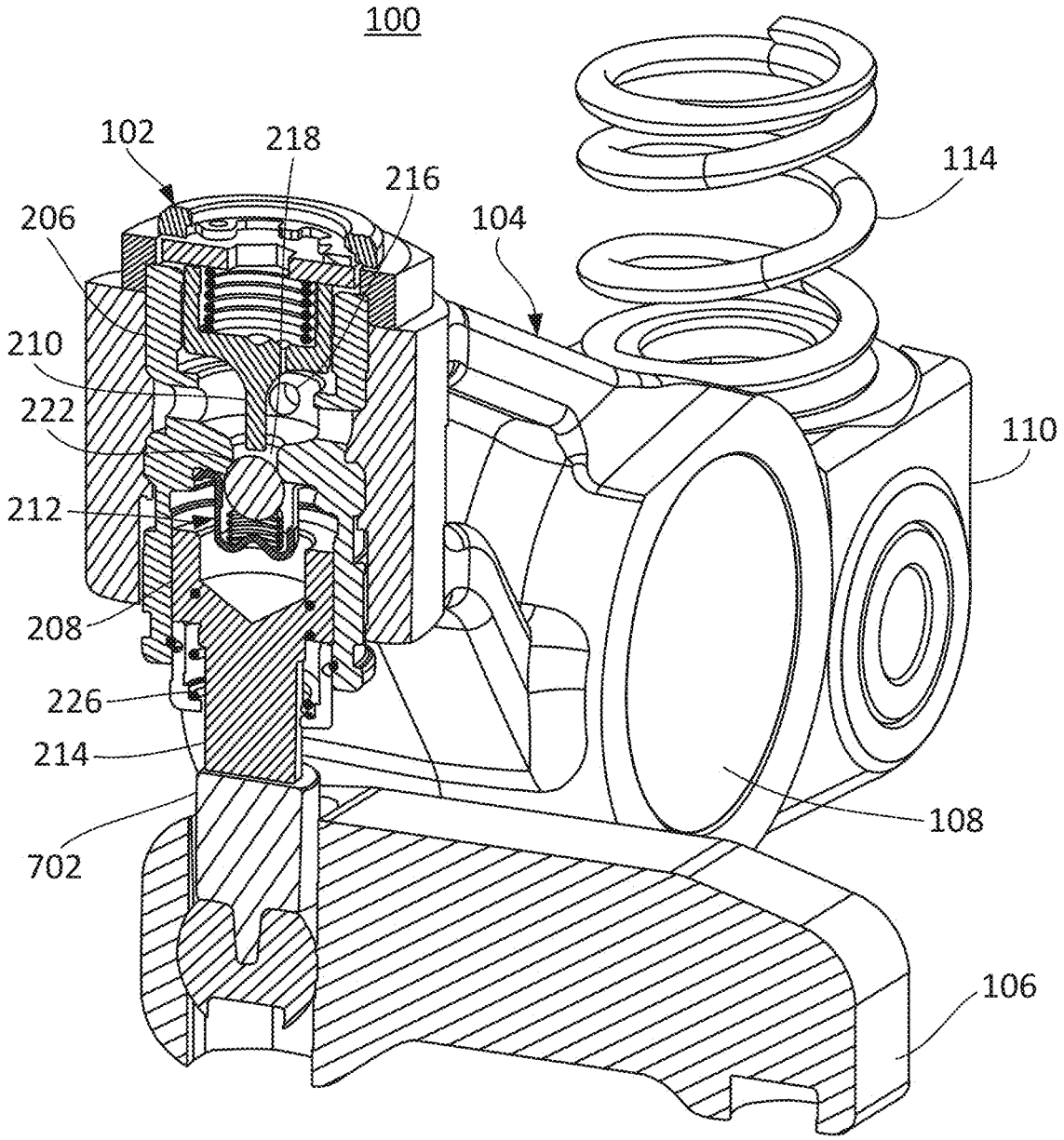

The switching process of the rocker arm assembly 100 will be more fully explained with reference to FIGS. 3-7, in which FIGS. 3-4 depicts the rocker arm assembly 100 during main exhaust operation with the hydraulic capsule 102 retracted, and FIGS. 5-7 depicts the rocker arm assembly 100 during engine brake with the hydraulic capsule 102 extended.

Referring now to FIGS. 3 and 4, during normal operation mode—i.e., drive mode—of the valvetrain system, the hydraulic capsule 102 may be deactivated and remain in its default retracted position where the lower end of the plunger 214 does not hit against the valve bridge 106 regardless of any rotational movement of the rocker arm assembly 100. Specifically, the plunger 214 is kept biased upwards by the spring force applied by the spring 226 such that any contact between the hydraulic capsule 102 and the valve bridge 106 is prevented when the brake mode is not active. Again, this may avoid wearing of the components that would otherwise occur due to unintended contact.

When the engine brake functionality is demanded, pressurized fluid may be sent through a fluid circuit 302 that runs inside the rocker arm 104 to the hydraulic capsule 102 via the fluid channel 216. The fluid may enter the upper chamber 206 and simultaneously push the pin 210 upwards into compression. The injected pressure may further push down the check ball 222 of the check valve assembly 212, thus unblocking the opening 218 to allow fluid to enter through the check valve assembly 212 to the lower chamber 208. As the lower chamber 208 is filled with fluid, the plunger will be hydraulicly actuated in the downward direction to its extended position where the lower end of the plunger 214 may protrude out from the bottom of the valve end 112. In this case, the system is active. This is illustrated in FIGS. 5-7.

During the active brake mode, the pressurized fluid is trapped inside the lower chamber 208 by virtue of the non-return characteristic of the check valve assembly 212 that prevents fluid to flow back upwards. At the same time, the pin 210 may stay retracted and distant from the check ball 222 to guarantee that the check ball 222 maintains its closed position against the opening 218 so that the lower chamber 208 is substantially pressure-tight. In this way, when the rocker arm assembly 100 rotates, the extended plunger 214 may engage the valve bridge 106, thus pushing the engine valve that is in contact with the valve bridge 106 to open, following the compression brake lift.

When switching back to non-brake mode, the system may be depressurized such that the fluid inside the upper chamber 206 may escape, e.g., from the fluid channel 216. Since the hydraulic pressure is no longer present in the upper chamber 206, the pin 210 may return to its extended position under the downward biasing force applied by the spring 220. In this case, the pin 210 may push down the check ball 222, thus opening the check valve assembly 212. Once opened, the fluid that is previously trapped inside the lower chamber 208 may be released out through the opening 218. As such, since the hydraulic force acting against the biasing force of the spring 226 is removed, the plunger 214 is pushed up by the spring 226 into retraction such that it is refrained from engaging with the valve bridge 106 even if the rocker arm assembly 100 rotates.

In some examples, as can be more clearly observed in FIG. 7, the valve bridge 106 may include a swinging pin mechanism 702 that may transfer motion from the rocker arm 104 to the one engine valve associated with engine braking while allowing the valve bridge 106 to swing a certain angular degree in a manner to avoid actuation of the other engine valve. Although depicted and described in this particular manner, a person of skill in the art will appreciate that the valve bridge configuration disclosed herein is provided for illustration purposes only, and not intended to limit the scope of this disclosure. Other suitable configuration is also envisioned by this disclosure. As a non-limiting example, a valve bridge with a sliding feature may alternatively be employed in order to individually actuate the selected valve.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A hydraulic capsule for use in a rocker arm, comprising:

an integrated housing comprising an upper chamber configured to receive pressurized fluid and a lower chamber configured to be in fluid communication with the upper chamber;

a pin disposed in the upper chamber and configured to be hydraulicly controlled to move between an extended position and a retracted position;

a check valve assembly disposed in the lower chamber and configured to selectively enable fluid communication between the upper chamber and the lower chamber based on the position of the pin;

a plunger at least partially disposed in the lower chamber and configured to be hydraulicly controlled to move between an extended position and a retracted position; and a first spring coupled to the plunger and configured to bias the plunger in the retracted position;

wherein in the retracted position of the plunger, the plunger does not contact a valve bridge during rotation of the rocker arm, and in the extended position of the plunger, the plunger is able to contact the valve bridge during rotation of the rocker arm.

2. The hydraulic capsule of claim 1, wherein the first spring is coupled to a lower end of the plunger.

3. The hydraulic capsule of claim 1, further comprising a spring seat attached to a lower end of the lower chamber and configured to support the first spring.

4. The hydraulic capsule of claim 1, wherein the plunger is configured to move to the extended position under hydraulic pressure inside the lower chamber.

5. The hydraulic capsule of claim 1, further comprising a second spring coupled to the pin and configured to bias the pin in the extended position.

6. The hydraulic capsule of claim 1, wherein the pin is configured to move to the retracted position under hydraulic pressure inside the upper chamber.

7. The hydraulic capsule of claim 1, wherein when the pin is in the extended position, the pin opens the check valve assembly to enable fluid communication between the upper chamber and the lower chamber.

8. The hydraulic capsule of claim 1, further comprising an opening between the upper chamber and the lower chamber for fluid communication.

9. The hydraulic capsule of claim 8, wherein the check valve assembly is disposed below the opening.

10. The hydraulic capsule of claim 1, wherein the plunger is in the extended position when the rocker arm is in engine brake mode and is in the retracted position when the rocker arm is in drive mode.

11. A rocker arm assembly for engine braking, comprising:

a rocker arm having a valve end; and a hydraulic capsule disposed in the valve end and comprising:

an integrated housing comprising an upper chamber configured to receive pressurized fluid and a lower chamber configured to be in fluid communication with the upper chamber, a pin disposed in the upper chamber and configured to be hydraulicly controlled to move between an extended position and a retracted position, a check valve assembly disposed in the lower chamber and configured to selectively enable fluid communication between the upper chamber and the lower chamber based on the position of the pin, a plunger at least partially disposed in the lower chamber and configured to be hydraulicly controlled to move between an extended position and a retracted position, and a first spring coupled to the plunger and configured to bias the plunger in the retracted position;

wherein in the retracted position of the plunger, the plunger does not engage a valve bridge during rotation of the rocker arm, and in the extended position of the plunger, at least a portion of the plunger extends outwards from the valve end and is able to engage the valve bridge during rotation of the rocker arm.

12. The rocker arm assembly of claim 11, further comprising a fluid circuit routed inside the rocker arm for supplying pressurized fluid to the hydraulic capsule.

13. The rocker arm assembly of claim 11, wherein the rocker arm further comprises a cam end for receiving motion from a camshaft.

14. The rocker arm assembly of claim 13, further comprising a lost motion spring coupled to the cam end and configured to bias the rocker arm against the camshaft.

15. The rocker arm assembly of claim 11, wherein the integrated housing of the hydraulic capsule is generally cylindrical in shape.

16. The rocker arm assembly of claim 15, wherein the valve end is structured with a bore for receiving the hydraulic capsule.

17. The rocker arm assembly of claim 11, wherein the first spring is coupled to a lower end of the plunger.

18. The rocker arm assembly of claim 11, wherein the hydraulic capsule further comprises a spring seat attached to a lower end of the lower chamber and configured to support the first spring.

19. The rocker arm assembly of claim 11, wherein the plunger is configured to move to the extended position under hydraulic pressure inside the lower chamber.

20. The rocker arm assembly of claim 11, wherein the plunger is in the extended position when the rocker arm is in engine brake mode and is in the retracted position when the rocker arm is in drive mode.

* * * * *